US006438874B1

(12) United States Patent
LaBounty et al.

(10) Patent No.: US 6,438,874 B1
(45) Date of Patent: Aug. 27, 2002

(54) HYDRAULIC ROTARY GRINDER FOR ATTACHMENT TO CONSTRUCTION MACHINERY

(75) Inventors: Kenneth R. LaBounty, Two Harbors; Ross D. Christenson, Esko; Daniel P. Jacobson, Wrenshall, all of MN (US)

(73) Assignee: Genesis Equipment and Manufacturing, Inc., Superior, WI (US)

( * ) Notice: Subject to any disclaimer, the term of this patent is extended or adjusted under 35 U.S.C. 154(b) by 0 days.

(21) Appl. No.: 09/658,104

(22) Filed: Sep. 8, 2000

(51) Int. Cl.[7] ..... E02F 3/96

(52) U.S. Cl. ..... 37/403; 37/189; 144/24.12; 404/92; 299/39.4

(58) Field of Search ..... 37/302, 403, 410, 37/189, 462; 144/24.12, 334, 375; 299/39.4, 39.1; 404/91, 92

(56) References Cited

U.S. PATENT DOCUMENTS

| | | | | |
|---|---|---|---|---|
| 4,041,996 | A | * | 8/1977 | Grover |
| 4,637,753 | A | * | 1/1987 | Swisher, Jr. |
| 5,158,126 | A | * | 10/1992 | Lang |
| 5,419,380 | A | * | 5/1995 | Bot |
| 5,555,652 | A | * | 9/1996 | Ashby |
| 5,718,271 | A | * | 2/1998 | Engelhoven |
| 5,738,155 | A | * | 4/1998 | Cochran |
| 5,975,644 | A | * | 11/1999 | Lang |
| 5,992,483 | A | * | 11/1999 | Bohnke |
| 6,047,749 | A | * | 4/2000 | Lamb |
| 6,230,770 | B1 | * | 5/2001 | Spaargaren |

FOREIGN PATENT DOCUMENTS

| | | | | |
|---|---|---|---|---|
| SU | 1021422 | * | 6/1983 | ..... 37/302 |

OTHER PUBLICATIONS

Brochure from Boart Longyear, entitled "Hydraulische Frasen Baureihe BF".

Brochure for ETH Series, entitled "The AC–E Hydraulic Milling Cutter, a cutting tool for universal use"., dated Jul. 1998 US.

Brochure from Lang Tool Co., for the LTC 290–LTC Hydraulic Tool Carrier.

Brochure from Webster Schaeff Group+Co, entitled "Mining Tunneling and Constructions Equipment".

* cited by examiner

*Primary Examiner*—Victor Batson
(74) *Attorney, Agent, or Firm*—Gerald E. Helget; Nelson R. Capes; Briggs and Morgan

(57) ABSTRACT

A hydraulic rotary grinder for attachment to construction machinery such as an excavator, consisting of a rotating drum having a hollow core and a plurality of attached replaceable grinding tips. A hydraulic motor rotates the drum, and is secured within the hollow core and activated by the hydraulic system of the construction machinery. A planetary gearbox is associated with the hydraulic motor to provide speed changes. At least one weight within the hollow core provides shock absorption and additional mass to the rotating drum. A heat-absorbing liquid within the hollow core absorbs heat from the grinding operation and a seal prevents the heat-absorbing liquid from leaking out of the drum. A number of water nozzles may be mounted on the apparatus for dust suppression. A second hydraulic motor may be provided for increased torque and grinding capacity.

16 Claims, 10 Drawing Sheets

HYDRAULIC ROTARY GRINDER FOR ATTACHMENT TO CONSTRUCTION MACHINERY

BACKGROUND OF THE INVENTION

The present invention relates to a hydraulic rotary grinder for attachment to construction machinery such as an excavator.

Hydraulic rotary grinders are used for a number of applications that require the destruction or demolition of materials, such as: quarry work, concrete demolition, soil remediation, commercial/residential construction, stump grinding, tunneling, and mine work.

Typically, hydraulic rotary grinders are attached to the arm of an excavator and derive power from the excavator hydraulics.

Past hydraulic rotary grinders had a number of deficiencies which the present invention overcomes.

First, earlier hydraulic rotary grinders often did not have enough mass for some applications, with the result that the rotary grinder took longer than necessary to complete the grinding operation.

Second, the grinding operation generated heat, and in past hydraulic rotary grinders it was necessary to provide a separate cooling system to cool the grinder.

Third, past hydraulic rotary grinders came in only one size to be used for all applications. It was found that the same drum size could not be used for concrete demolition and for digging a narrow, deep trench.

SUMMARY OF THE INVENTION

A hydraulic rotary grinder for attachment to construction machinery such as an excavator, the grinder comprising:

a) a rotating drum;

b) the rotating drum having a plurality of replaceable grinding tips attached thereto;

c) a hydraulic motor adapted to rotate the drum, the hydraulic motor being activated by the hydraulic system of the construction machinery, further comprising a planetary gearbox associated with the hydraulic motor; and d) wherein the rotating drum encloses a hollow core therein and further comprising at least one weight within the hollow core, the weight being adapted to provide shock absorption and additional mass to the rotating drum and further comprising heat-absorbing liquid within the hollow core and a seal adapted to prevent the heat-absorbing liquid from leaking out of the drum.

A principal object and advantage of the present invention is that includes a hollow core within the rotating drum with at least one weight within the hollow core to provide additional mass and shock absorption.

Another object and advantage of the present invention is that the hydraulic motor may be enclosed within the hollow core to prevent damage to the motor and to take up less space.

A second principal object and advantage of the present invention is that includes a heat-absorbing liquid within the hollow core and a seal adapted to prevent the heat-absorbing liquid from leaking out of the drum. This eliminates the need for a supplemental cooling system.

Another principal object and advantage of the present invention is that it features an optional rotating wheel attachable to the rotating drum for use in deep and narrow trenching applications.

Another principal object and advantage of the present invention is that a second hydraulic motor may be mounted on the rotating drum to add increased horsepower for rotating the drum.

Another principal object and advantage of the present invention is that it provides a fender on the rotating drum to prevent material from flying away from the rotating drum.

Another principal object and advantage of the present invention is that it has optional water nozzles directed toward the rotating drum to assist in dust suppression.

BRIEF DESCRIPTION OF THE DRAWINGS

FIG. 7 is a front perspective view of the hydraulic rotary grinder of the present invention with an attached grinding wheel;

FIG. 12 is similar to FIG. 8, but shows a second embodiment of the invention with water nozzles;

DETAILED DESCRIPTION OF THE PREFERRED EMBODIMENT

Figure 1A:
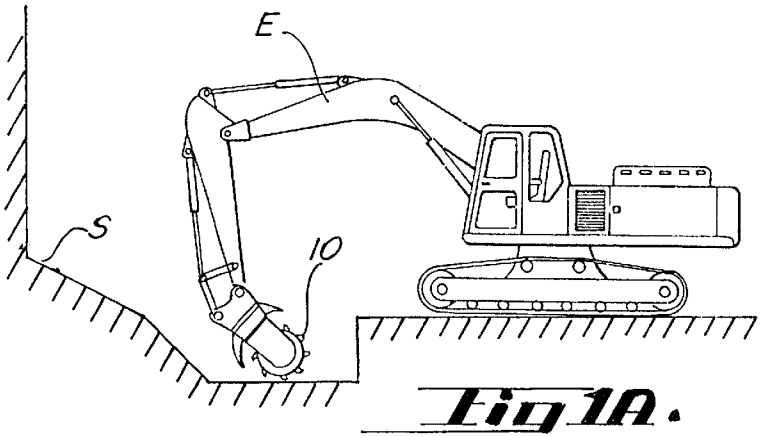
FIGS. 1A–1E show the hydraulic rotary grinder of the present invention attached to an excavator for use in a variety of applications.
Figure 1B:
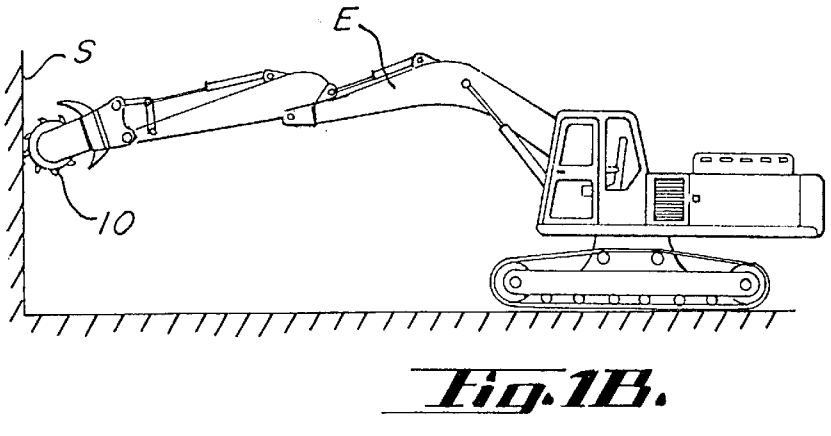
Figure 1C:
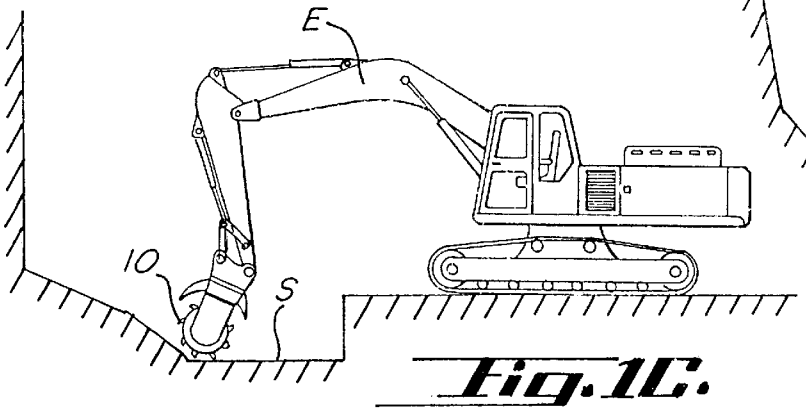
Figure 1D:
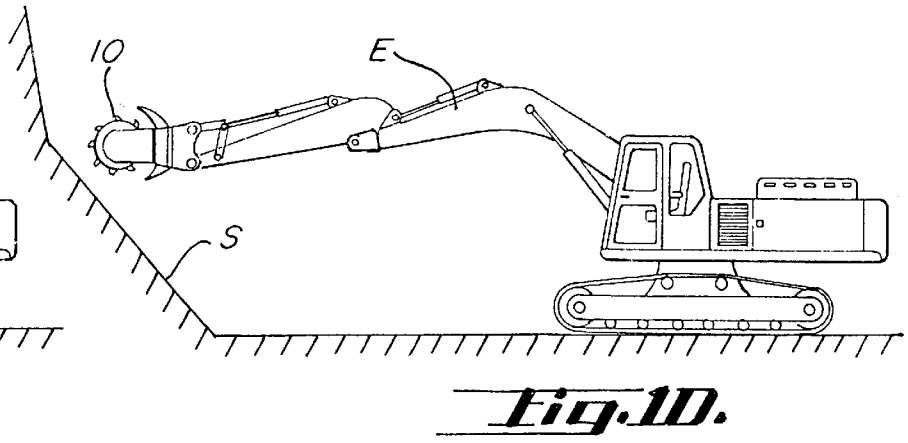
Figure 1E:
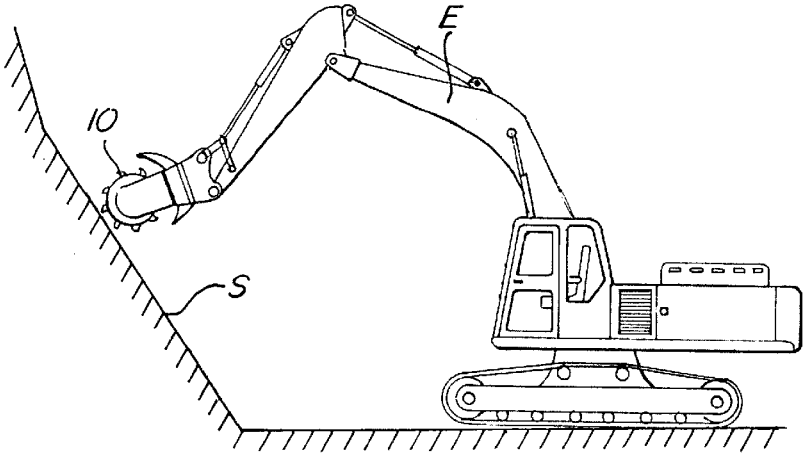

The hydraulic rotary grinder of the present invention is generally shown in the Figures as reference numeral 10.

As can be seen in FIGS. 1A–1E, the hydraulic rotary grinder 10 of the present invention is attachable to construction machinery such as an excavator E. When attached to the excavator 10, the hydraulic rotary grinder may be used in a variety of applications for grinding surfaces S. For example, the surface S may be essentially horizontal (FIGS. 1A and 1C) and the grinder may be used in applications such as tunneling. Alternatively, the surface S may be essentially vertical (FIG. 1B) or inclined (FIGS. 1D and 1E) and the grinder may be used in applications such as concrete demolition and commercial/residential construction.

Figure 2:
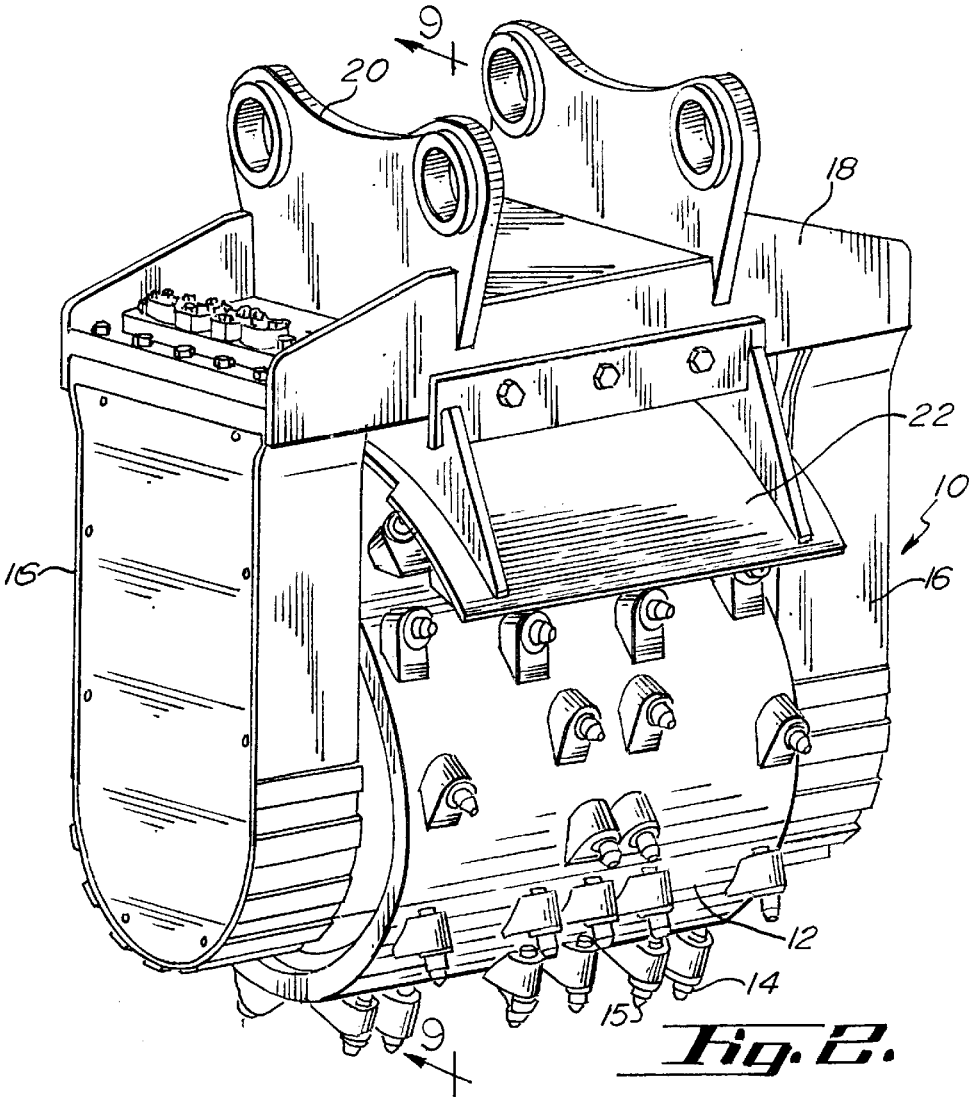
FIG. 2 is a front side perspective view of the hydraulic rotary grinder of the present invention.

Turning to FIG. 2, the hydraulic rotary grinder 10 may be seen to comprise a rotating drum 12 with a plurality of replaceable grinding tips 14 thereon. The drum is suspended between two outboard supports 16 which are attached to a base 18. The base 18 in turn is attached to an excavator by the coupler 20. Optionally, a fender 22 may be attached to the grinder 10 to prevent material ground by the rotating drum 12 from flying away from the rotating drum.

The grinding tips 14 are constructed of heat-treated steel or other highly durable material and are equipped with carbide inserts 15.

Figure 5:
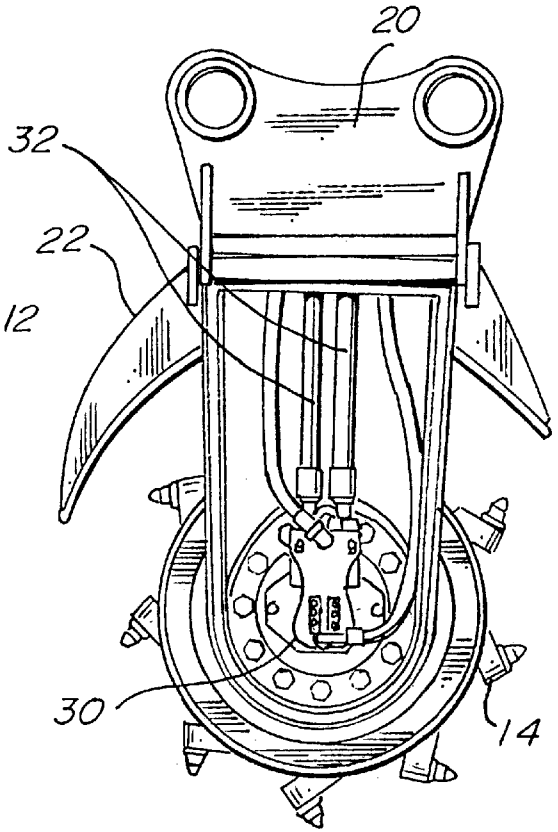
FIG. 5 is a left side elevational view of the hydraulic rotary grinder of the present invention.
Figure 4:
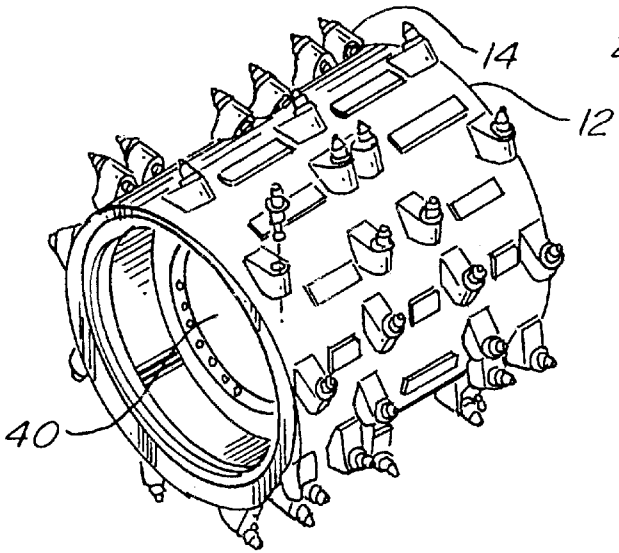
FIG. 4 is a perspective view of the rotating drum of the hydraulic rotary grinder of the present invention.
Figure 3:
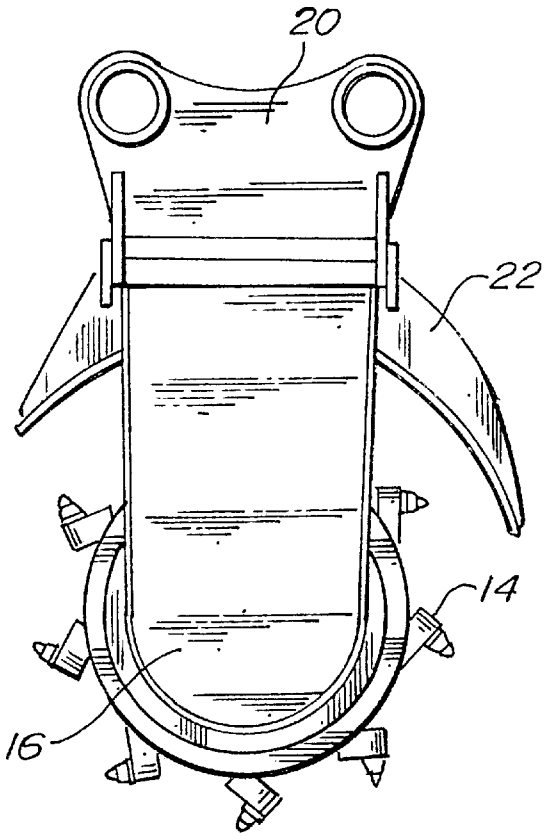
FIG. 3 is a right side elevational view of the hydraulic rotary grinder of the present invention.
Figure 8:
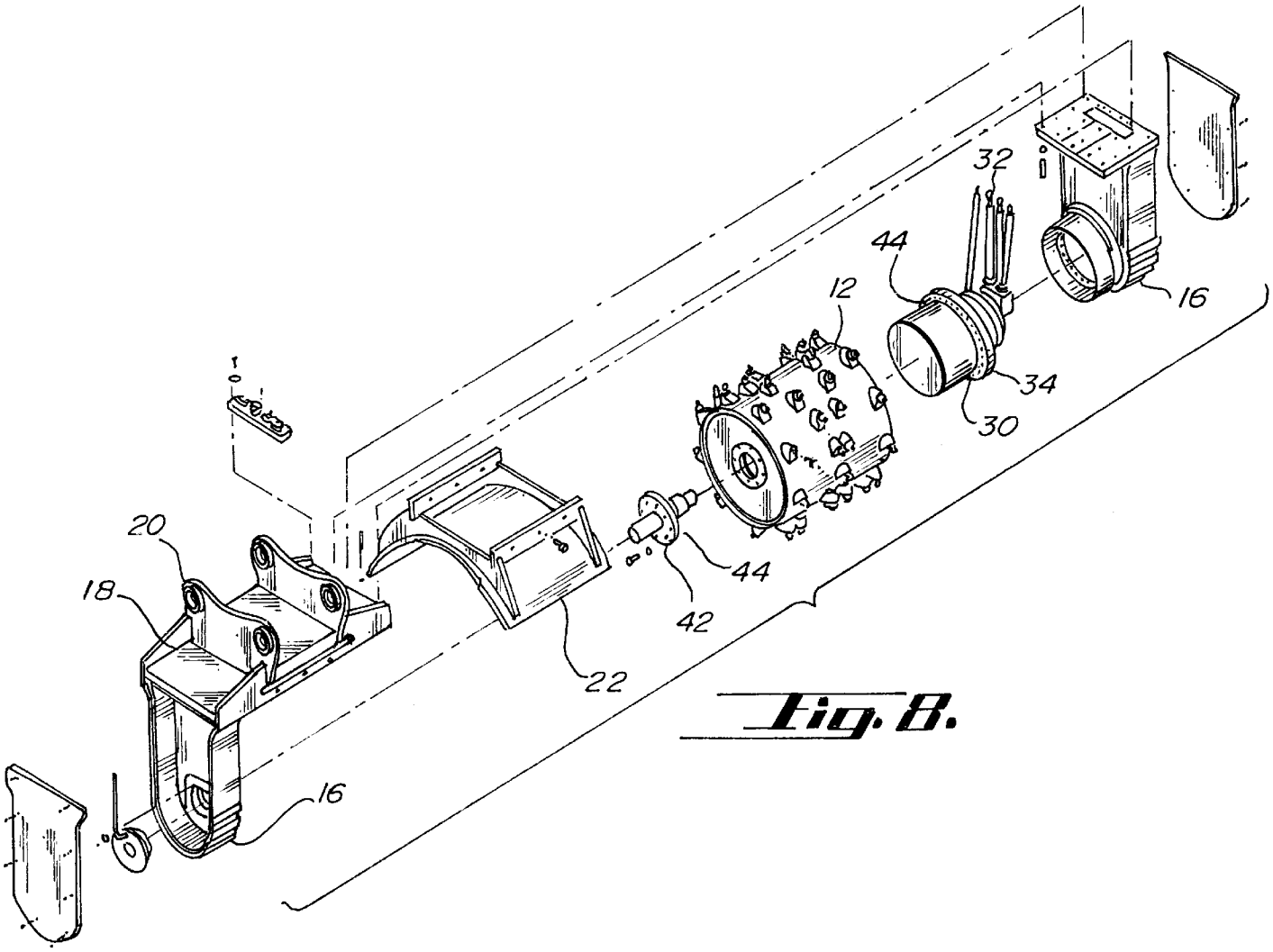
FIG. 8 is an exploded view of the hydraulic rotary grinder of the present invention.
Figure 11:
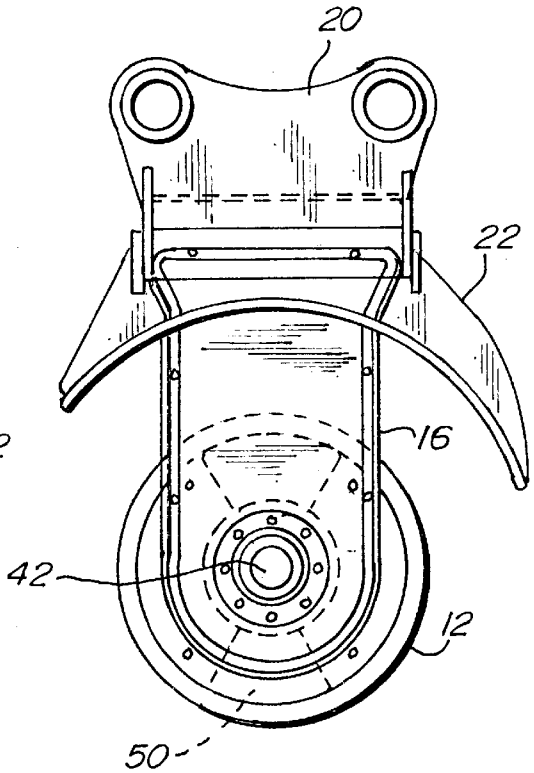
FIG. 11 is a cross-section taken at approximately the lines 11 of FIG. 9.
Figure 9:
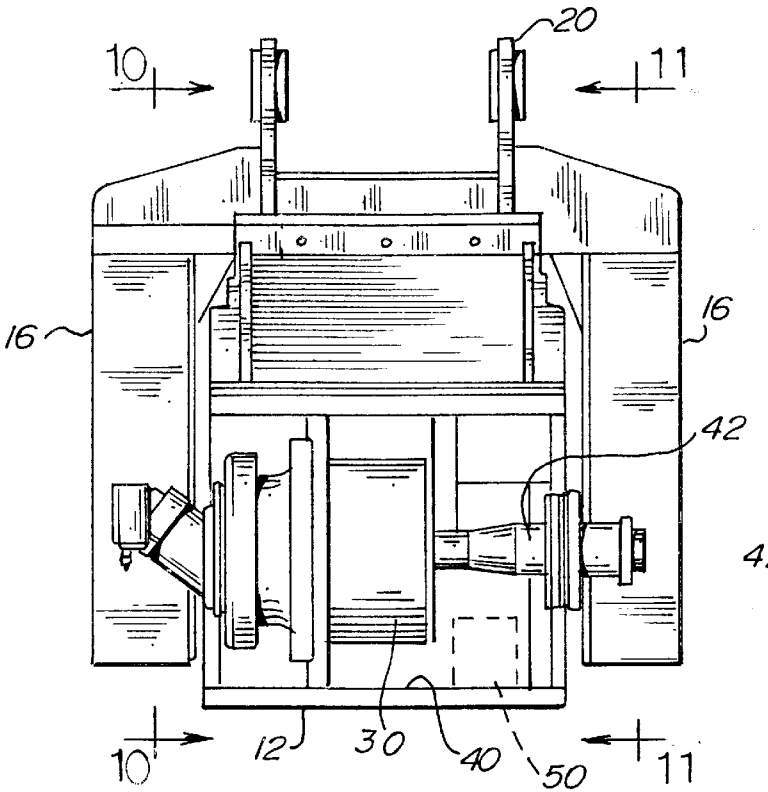
FIG. 9 is a cross-section taken at approximately the lines 9 of FIG. 2 with some internal structure shown in phantom.
Figure 10:
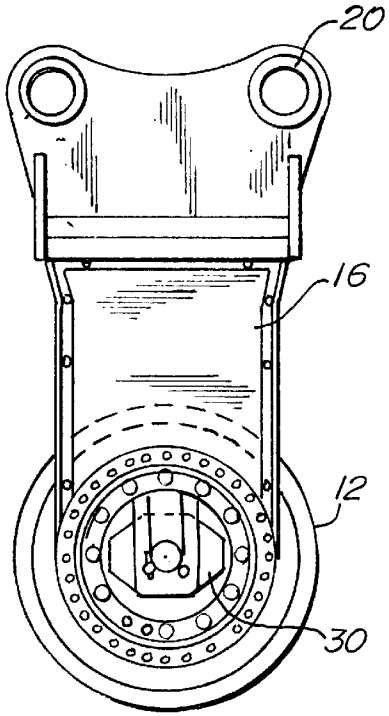
FIG. 10 is a cross-section taken at approximately the lines 10 of FIG. 9.
Figure 18:
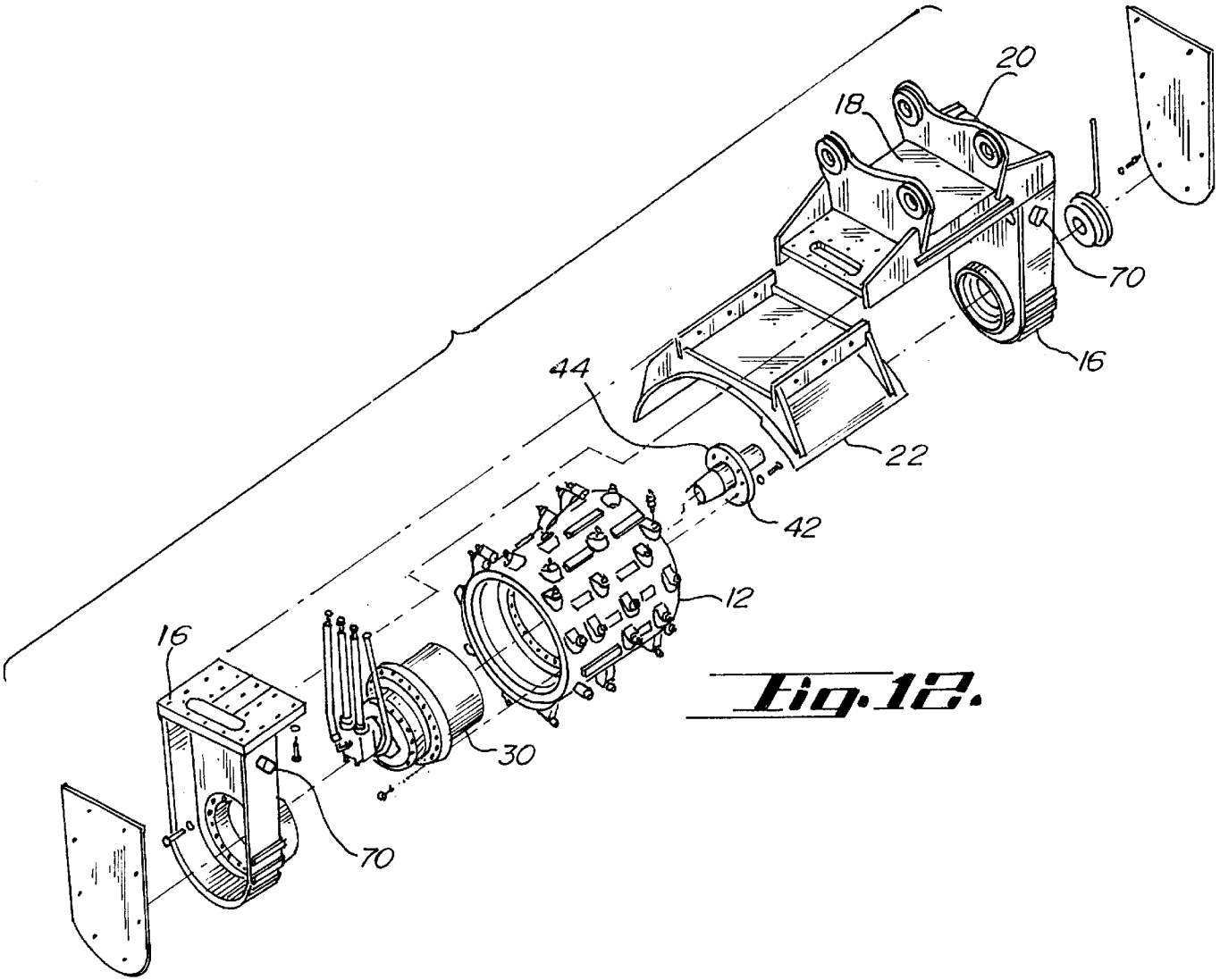

As best seen in FIGS. 5 and 8, the hydraulic grinder 10 further comprises a hydraulic motor 30 that is activated by the hydraulic system of the excavator E through hoses 32. The hydraulic motor 30 is associated with a planetary gearbox 34 for speed changes.

Preferably, the rotating drum 12 has a hollow core 40 therein and the hydraulic motor 30 is placed within the core 40, so that it does not take up additional space outside the drum and is protected from damage. The motor 30 supports the drum 12 at one end and engages the drum 10 for rotary motion.

An axle 42 supports the drum 12 at its other end and is in turn attached to one of the outboard supports 16 for rotary motion.

At least one weight 50 may be placed within the hollow core 40, to provide shock absorption to the drum and to provide additional mass to the rotating drum for more efficient grinding.

The drum 12 preferably contains a heat-absorbing liquid (not shown) such as hydraulic oil within the hollow core 40. Heat caused by the grinding operation will be absorbed by the liquid, thereby eliminating the need for a separate cooling system. Seals 44 prevent the heat-absorbing liquid from leaking from the drum. The seals may be any type of gasket and may simply be painted-on flexible material such as rubber.

Figure 6:
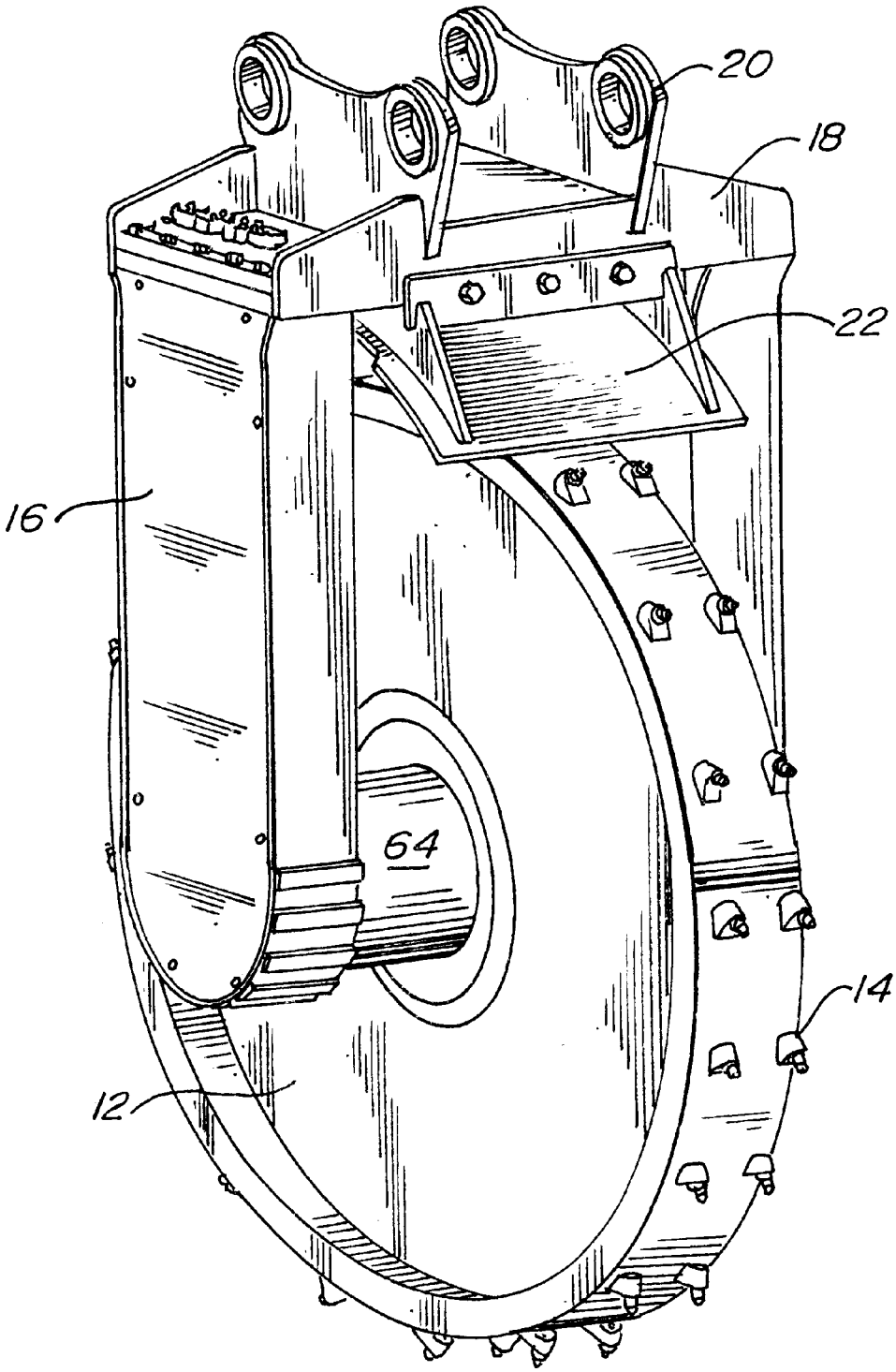
FIG. 6 is a front perspective view of the hydraulic rotary grinder of the present invention with a larger, narrower drum for deep and narrow trenching applications.
Figure 4:
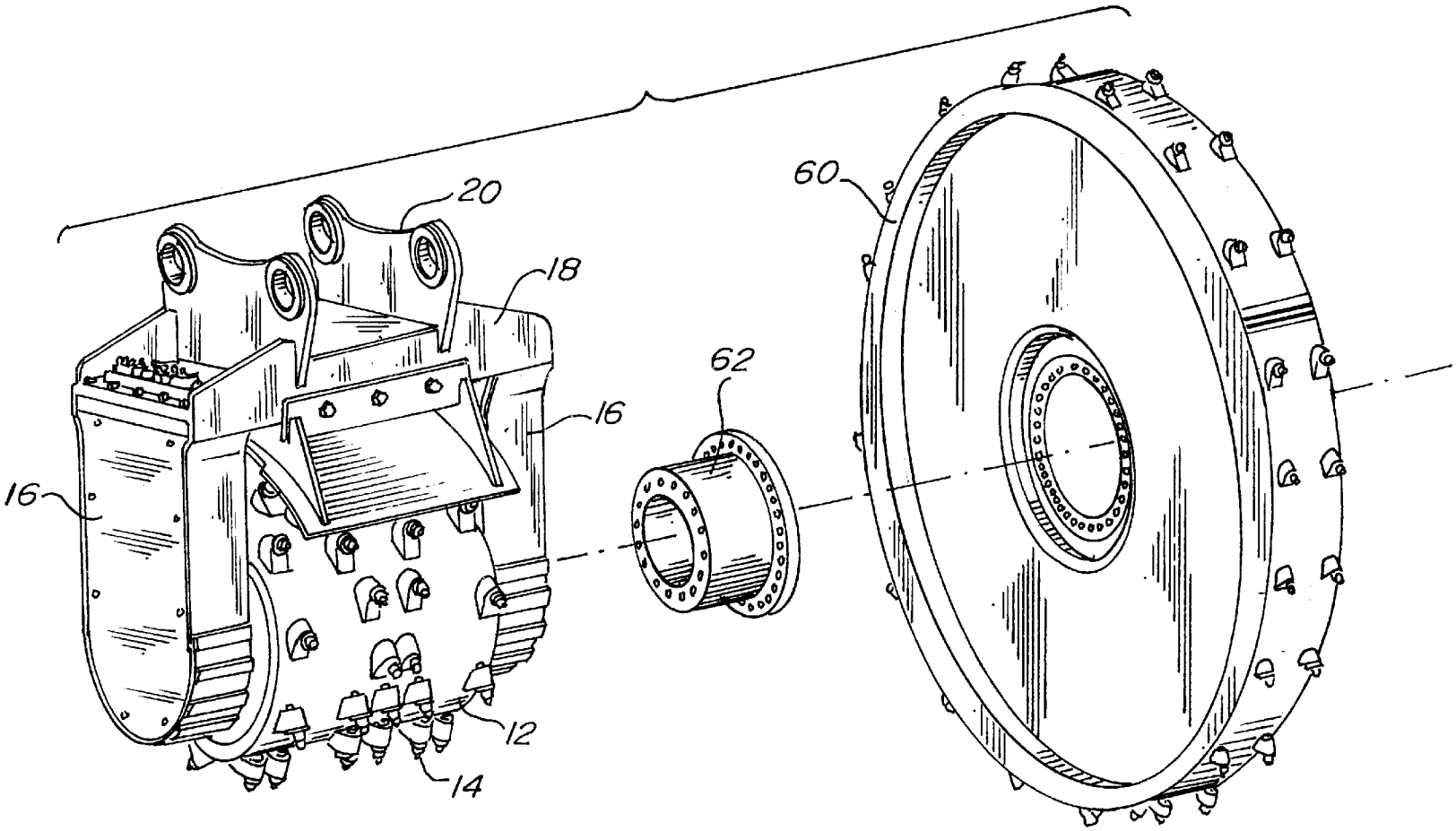

For use in deep and narrow trenching applications, a rotating wheel 60 may be attached to the drum 12 by wheel hub 62, as best seen in FIG. 7. Alternatively, the drum 12 may be constructed to be larger and narrower, as best seen in FIG. 6, in which case a spacer 64 may be employed to attach the drum 12 to the outboard supports 16.

Figure 13:
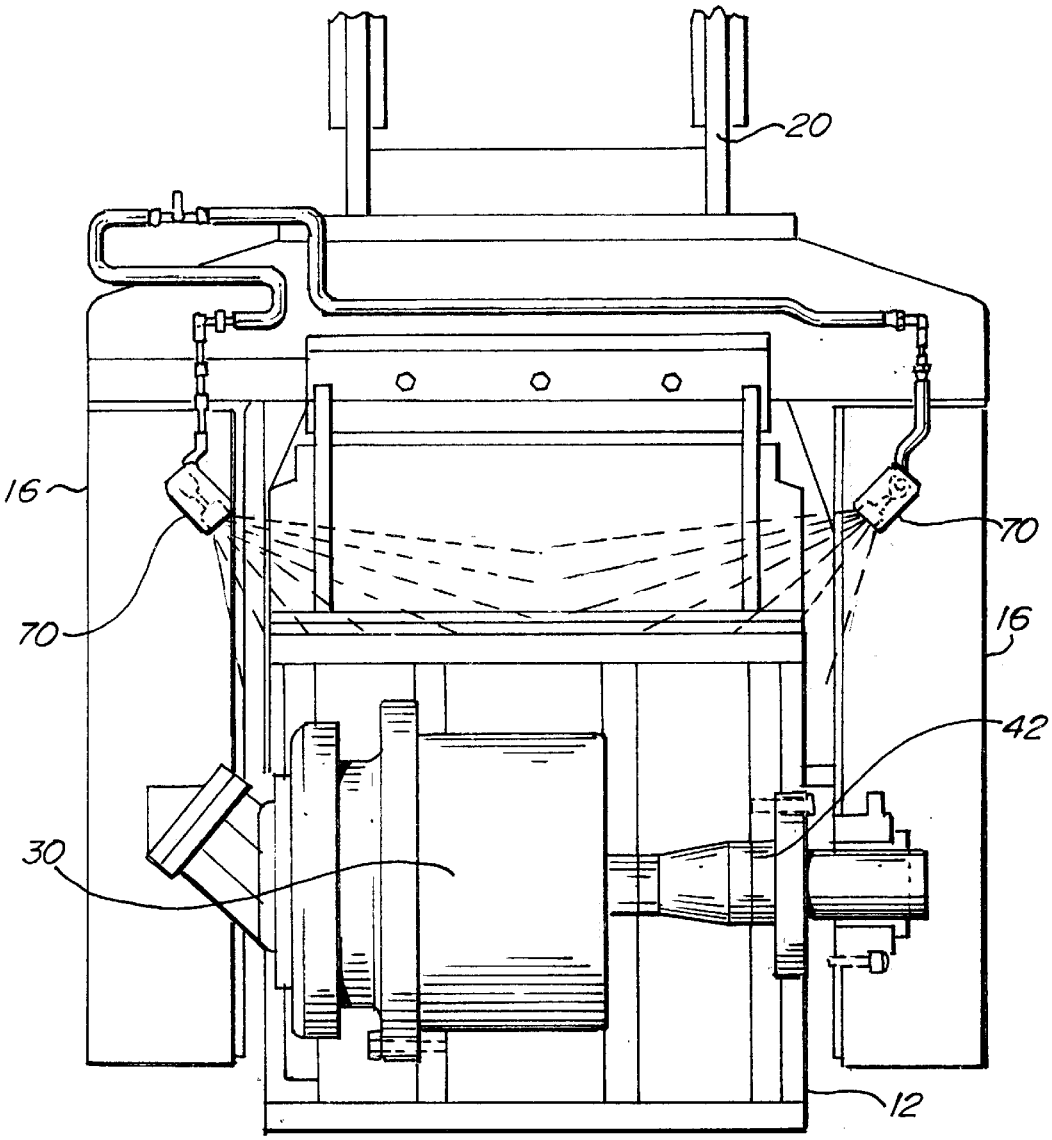
FIG. 13 is similar to FIG. 9, but shows a second embodiment of the invention with water nozzles.

Turning to FIGS. 12 and 13, a second embodiment of the invention is shown. Optionally, water nozzles 70 may be mounted on the grinder 10 directed toward the rotating drum 12 to assist in dust suppression.

Figure 14:
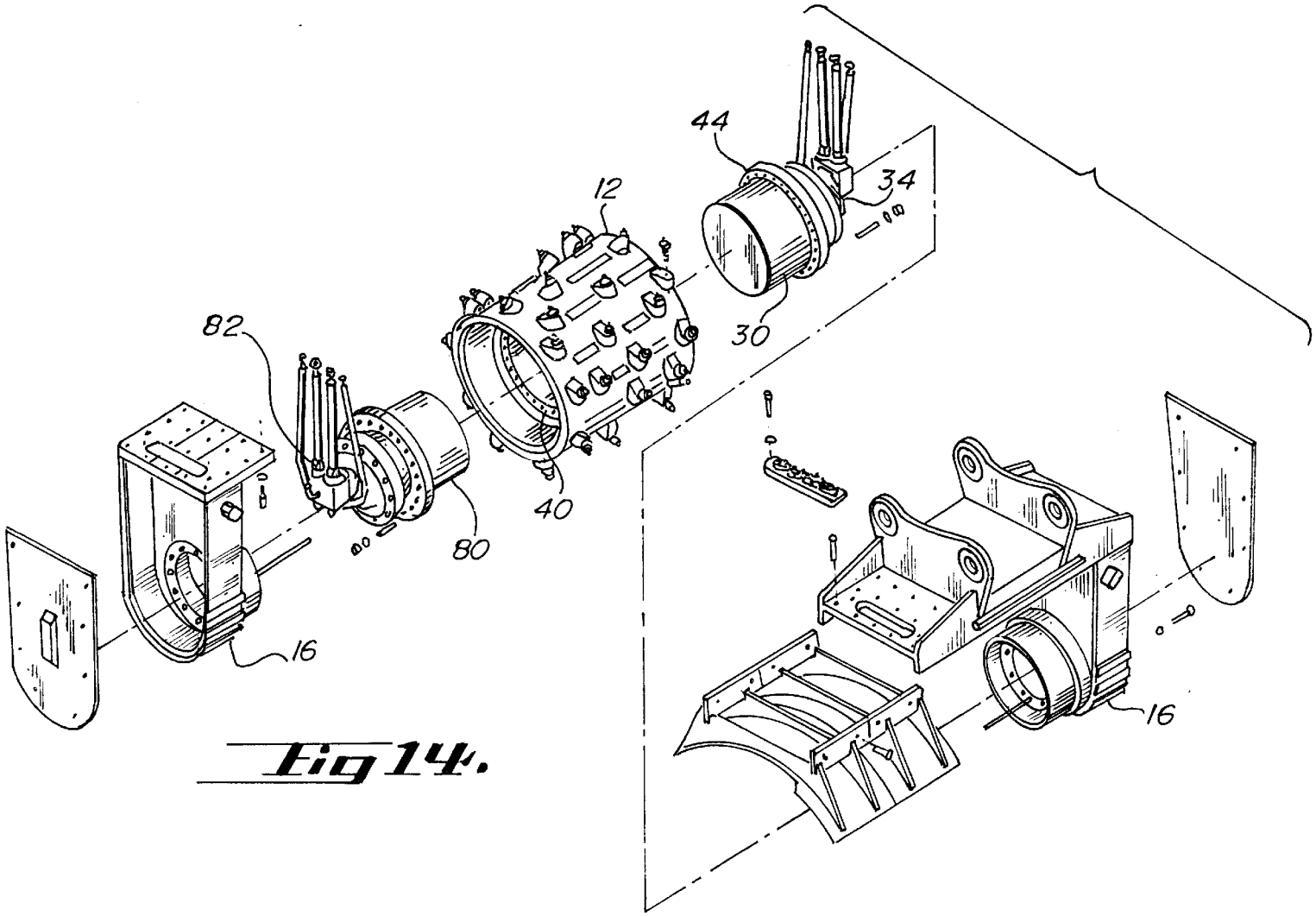
FIG. 14 is similar to FIG. 8, but shows a third embodiment of the invention with a second hydraulic motor.

FIG. 14 shows a third embodiment of the grinder 10 of the present invention. The third embodiment includes a second hydraulic motor 80 secured within the hollow core 40. A second planetary gearbox 82 is associated with the second hydraulic motor 80 for speed changes.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A hydraulic rotary grinder for attachment to construction machinery having a hydraulic system, the grinder comprising:

(a) a rotating drum;

(b) the rotating drum having a hollow core and a plurality of attached replaceable grinding tips;

(c) a hydraulic motor adapted to rotate the drum and secured within the hollow core, the hydraulic motor being activated by the hydraulic system of the construction machinery; and (d) a rotating wheel attachable to the rotating drum, the rotating wheel being adapted to use in deep and narrow trenching applications.

2. The hydraulic rotary grinder of claim 1, further comprising a planetary gearbox associated with the hydraulic motor.

3. The hydraulic rotary grinder of claim 1, further comprising at least one weight within the hollow core, the weight being adapted to provide shock absorption and additional mass to the rotating drum.

4. The hydraulic rotary grinder of claim 1, further comprising heat-absorbing liquid within the hollow core and a seal adapted to prevent the heat-absorbing liquid from leaking out of the drum.

5. The hydraulic rotary grinder of claim 1, further comprising a second hydraulic motor secured within the hollow core, activated by the hydraulic system of the construction machinery, and adapted to rotate the drum.

6. The hydraulic rotary grinder of claim 1, further comprising a fender adapted to prevent material ground by the rotating drum from flying away from the rotating drum.

7. The hydraulic rotary grinder of claim 1, further comprising a plurality of water nozzles mounted thereon directed toward the rotating drum and adapted for dust suppression.

8. A hydraulic rotary grinder for attachment to construction machinery having a hydraulic system, the grinder comprising:

(a) a rotating drum;

(b) the rotating drum having a hollow core and a plurality of attached replaceable grinding tips;

(c) a hydraulic motor adapted to rotate the drum and secured within the hollow core, the hydraulic motor being activated by the hydraulic system of the construction machinery, further comprising a planetary gearbox associated with the hydraulic motor;

(d) at least one weight within the hollow core, the weight being adapted to provide shock absorption and additional mass to the rotating drum; and (e) a rotating wheel attachable to the rotating drum, the rotating wheel being adapted to use in deep and narrow trenching applications.

9. The hydraulic rotary grinder of claim 8, further comprising heat-absorbing liquid within the hollow core and a seal adapted to prevent the heat-absorbing liquid from leaking out of the drum.

10. The hydraulic rotary grinder of claim 8, further comprising a second hydraulic motor secured within the hollow core, activated by the hydraulic system of the construction machinery, and adapted to rotate the drum.

11. The hydraulic rotary grinder of claim 8, further comprising a fender adapted to prevent material ground by the rotating drum from flying away from the rotating drum.

12. The hydraulic rotary grinder of claim 8, further comprising a plurality of water nozzles mounted thereon directed toward the rotating drum and adapted for dust suppression.

13. A hydraulic rotary grinder for attachment to construction machinery having a hydraulic system, the grinder comprising:

(a) a rotating drum;

(b) the rotating drum having a hollow core and a plurality of attached replaceable grinding tips;

(c) a hydraulic motor adapted to rotate the drum, the hydraulic motor being secured within the hollow core and activated by the hydraulic system of the construction machinery, further comprising a planetary gearbox associated with the hydraulic motor;

(d) at least one weight within the hollow core, the weight being adapted to provide shock absorption and additional mass to the rotating drum and further comprising hear-absorbing liquid within the hollow core and a seal adapted to prevent the heat-absorbing liquid from leaking out of the drum;

(e) a rotating wheel attachable to the rotating drum, the rotating wheel being adapted to use in deep and narrow trenching applications.

14. The hydraulic rotary grinder of claim 13, further comprising a second hydraulic motor secured within the hollow core, activated by the hydraulic system of the construction machinery, and adapted to rotate the drum.

15. The hydraulic rotary grinder of claim 13, further comprising a fender adapted to prevent material ground by the rotating drum from flying away from the rotating drum.

16. The hydraulic rotary grinder of claim 13, further comprising a plurality of water nozzles mounted thereon directed toward the rotating drum and adapted for dust suppression.

* * * * *